US009673504B2

(12) United States Patent
Meharry

(10) Patent No.: US 9,673,504 B2
(45) Date of Patent: Jun. 6, 2017

(54) MINIATURIZED MULTI-SECTION DIRECTIONAL COUPLER USING MULTI-LAYER MMIC PROCESS

(71) Applicant: BAE Systems Information and Electronic Systems Integration Inc., Nashua, NH (US)

(72) Inventor: David E. Meharry, Lexington, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 14/827,991

(22) Filed: Aug. 17, 2015

(65) Prior Publication Data

US 2016/0056521 A1 Feb. 25, 2016

Related U.S. Application Data

(60) Provisional application No. 62/040,447, filed on Aug. 22, 2014.

(51) Int. Cl.

| | |
|---|---|
| ***H01P 5/18*** | (2006.01) |
| ***H01P 9/00*** | (2006.01) |
| *H01P 3/08* | (2006.01) |

(52) U.S. Cl.

CPC ..... *H01P 5/187* (2013.01); *H01P 5/185* (2013.01); *H01P 9/006* (2013.01)

(58) Field of Classification Search

CPC ..... H01P 5/18; H01P 5/185; H01P 5/187
USPC ..... 333/109–112, 116
See application file for complete search history.

(56) References Cited

U.S. PATENT DOCUMENTS

| | | | | |
|---|---|---|---|---|
| 5,111,165 | A * | 5/1992 | Oldfield | H01P 5/187 333/109 |
| 5,742,210 | A * | 4/1998 | Chaturvedi | H01P 5/187 333/116 |
| 6,747,525 | B2 * | 6/2004 | Iida | H01P 5/185 333/109 |
| 7,245,192 | B2 * | 7/2007 | Podell | H01P 5/187 333/112 |
| 7,414,493 | B1 * | 8/2008 | Hussain | H01P 5/185 333/109 |
| 8,044,749 | B1 * | 10/2011 | Witas | H01P 5/185 333/112 |
| 9,214,715 | B2 * | 12/2015 | Mei | H01P 5/187 |
| 9,413,054 | B2 * | 8/2016 | Hash | H01P 5/184 |

* cited by examiner

*Primary Examiner* — Dean Takaoka
(74) *Attorney, Agent, or Firm* — Hayes Soloway P.C.; Scott J. Asmus

(57) ABSTRACT

A miniaturized multi-sectioned, directional coupler using a multi-layer MMIC process, the coupler comprising, a monolithic microwave integrated circuit, having a central section with a relatively tight coupling, surrounded by sections of lighter coupling, the relatively tight coupling being comprised of a pair of spiral coupled lines, and the lighter coupling being comprised of meandered edge couple lines with capacitive loading of the lines in several places.

24 Claims, 12 Drawing Sheets

MINIATURIZED MULTI-SECTION DIRECTIONAL COUPLER USING MULTI-LAYER MMIC PROCESS

CROSS REFERENCE TO RELATED APPLICATION

This application claims benefit of U.S. Provisional Application Ser. No. 62/040,447 entitled, "MINIATURIZED MULTI-SECTION DIRECTIONAL COUPLER USING MULTI-LAYER MMIC PROCESS" filed Aug. 22, 2014, the entire disclosure of which is incorporated herein by reference.

STATEMENT OF GOVERNMENT INTEREST

This invention was made with United States Government support under Contract No. N00019-10-C-0070 awarded by the US Department of the Navy. The United States Government has certain rights in this invention.

FIELD OF THE INVENTION

The present invention relates to microwave integrated circuits, and more specifically to miniaturized, broadband microwave directional couplers, specifically quadrature directional couplers that use spiral broad side coupled lines.

BACKGROUND OF THE INVENTION

Existing quadrature couplers for matching and combining of monolithic microwave integrated circuit (MMIC) power amplifiers are limited in bandwidth to about 3:1, due to fundamental limits, and are furthermore limited in size by the necessity of the structure being approximately a quarter wavelength at the center frequency of operation. There is therefore a need for ultra-small and wider bandwidth directional couplers useful in a number of applications. For instance, quadrature couplers are used in mixers and matching other nonlinear components such as limiters. Thus, microwave directional couplers are important and versatile components used in a large variety of applications, including mixers, power splitters and combiners, test equipment, and many others.

Directional couplers are four-port circuits which, in the simplest instance, comprise a pair of coupled lines with an electromagnetic coupling between the lines. The wave propagation down these lines can be described in terms of two modes: an even mode and an odd mode. These waves may also propagate down the lines with different velocities. These types of couplers may include edge coupled, multiple edge coupled, broadside coupled, and spiral edge coupled circuits. In general, tighter coupling is needed for broader bandwidth operation. As will be appreciated, coupling strength is determined in part by how close together the lines are situated. However, there is a practical limitation on how close together the lines can be made.

One common arrangement for coupled lines has long rectangular strips of metal placed side by side on a flat or planar dielectric material in the so-called edge coupled configuration. The coupling strength in this case may be severely limited, but can be increased by using multiple, appropriately interconnected, pairs of these lines. One such arrangement is called the Lange coupler. Arranging the conducting strips so that one is stacked on top of the other, in a so-called 'broad side coupled configuration', can further increase the available coupling. To be of practical use, the dimensions and configuration of the two lines must be such that the coupling is the desired strength, and that the structure is well matched to each of the four connecting ports, a typical value being 50 ohms. Simultaneously fulfilling these criteria may not be possible with achievable dimensions.

With current planar technology, it is a relatively straightforward task to achieve a matched impedance for the four ports in a single section style coupler. However, a single section coupler, theoretically, has a band limit, which is typically a tradeoff with the amount of allowed over-coupling. For instance, a peak-to-peak over coupling of 1 dB has a maximum theoretical bandwidth of about 2.4:1. The Lange coupler utilizes an edge coupling technique and seeks to increase the bandwidth by tightening the coupling utilizing interdigitated interconnections between planar transmission lines. However, this technique can only be extended so far. A single Lange coupler section is limited to <2 dB of over coupling. The edge coupled Lange coupler is also relatively large due to the requirement to be approximately one quarter wavelength long at the center frequency of operation.

By using multiple quarter-wave coupled line sections it is possible to greatly increase the bandwidth of operation. However, this further complicates miniaturization for integrated circuit applications. For instance, while single section quadrature couplers can only theoretically have a maximum bandwidth of 2.4:1, one can increase the bandwidth of the directional coupler by adding sections. Typically in a multi-section coupler, there are at least three sections, with the center section requiring the most tightly coupled lines. When trying to increase the bandwidth of the aforementioned Lange coupler, the size of the center section is approximately as large as the outer two sections, which dramatically increases the size of the directional coupler.

Therefore, there is a need in a multi-section coupler to minimize the size of the center section while at the same time providing it with a tight coupling characteristic.

SUMMARY OF THE INVENTION

Embodiments of the present disclosure provide a system and method for a miniaturized multi-section directional coupler using a multi-layer MMIC process. Briefly described, in architecture, one embodiment of the system, among others, can be implemented as follows. A miniaturized directional coupler comprises a broadside coupled stacked pair of spirals.

The present disclosure can also be viewed as providing a miniaturized, multi-sectioned, directional coupler using a multi-layer monolithic microwave integrated circuit (MMIC) process. Briefly described, in architecture, one embodiment of the coupler, among others, can be implemented as follows. The coupler has a monolithic microwave integrated circuit, having a central section with a tight coupling surrounded by sections of lighter coupling, the tight coupling being comprised of a pair of broadside coupled spiral lines, and the lighter coupling being comprised of meandered edge coupled lines.

The present disclosure can also be viewed as providing an apparatus, which briefly described, in one embodiment of the coupler, among others, can be implemented as miniaturized broadside coupled spirals used as a component in one of: directional couplers, baluns, microwave frequency transformers, filters, and mixers.

The present disclosure can also be viewed as providing a method for improving the bandwidth of a multi-section directional coupler having a center section. In this regard, one embodiment of such a method, among others, can be broadly summarized by the following step: providing the center section with a pair of broadside coupled stacked spirals.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 10 B is a diagrammatic illustration of a twisted line configuration in which lines of the top and bottom spirals are separated and interconnected, in accordance with the first exemplary embodiment of the present disclosure;

DETAILED DESCRIPTION

Figure 1:
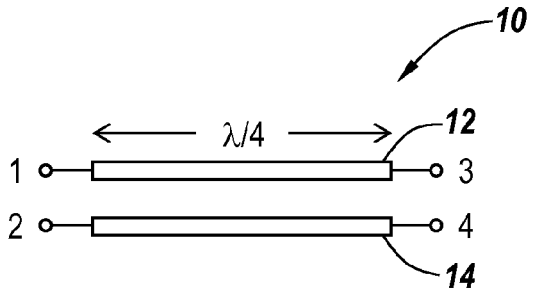
FIG. 1 is a diagrammatic representation of a directional coupler composed of two parallel lines a quarter wavelength long showing a four port structure, in accordance with a first exemplary embodiment of the present disclosure.

Prior to further describing the subject invention in detail, it will be appreciated that quadrature directional couplers are extraordinarily useful devices in microwave circuitry with many kinds of implementations possible, most commonly ones used on planar circuits. Planar circuits are typically those that utilize quartz, alumina or, in the case of gallium arsenide integrated circuits, a gallium arsenide substrate onto which patterns are formed utilizing a conductor such as gold or copper, which is typically a quarter wavelength long at the center frequency of operation. These structures include interconnections at four points. These points are positioned in close proximity so that there is a strong electromagnetic coupling between the lines. One can adjust the coupling between the lines and the characteristic impedances of the structure so that one can end up with a signal input on one of the four ports and whereas the two remaining ports have signals coming out with equal amplitude and 90° phase differences, there being nothing coming out of the fourth port. These type of couplers are typically referred to as 3 dB couplers which refers to the fact that the amplitude of the 90° phase shifted output signals at the two output ports are one half the amplitude of the input signal.

In microwave circuits these structures tend to be quarter wavelength in size, having a useful bandwidth of operation that is approximately 2:1 or 3:1 depending on the intended usage and design parameters that are used. However, there are many cases in which one may wish to have a bandwidth which is much greater than 2:1 or 3:1. According to circuit theory, one cannot obtain this greater bandwidth with only a single section. It is noted that these structures can be made more compact by meandering or winding the lines back and forth on themselves. However, if the meander lines are too close together then undesired coupling occurs which can decrease the effective coupling. It may also be necessary to further increase the length of the meandered section in this case.

One of the reasons that this quadrature coupler is particularly useful is that equally split powers but 90° phase difference signals can be achieved. Given an identical pair of amplifiers which individually have poor input or output match, the additional use of an ideal quadrature coupler enables perfect match of the combination. For example, consider what happens when the amplifiers are each placed at one of the equally split ports. A signal that enters the coupler is split in two equal parts. Equal portions of the signal enter each amplifier and equal portions are reflected back into the quadrature coupler. The reflected portions acquire an additional 90° phase difference, for a total of 180°, and are therefore canceled at the input. This reflected power is absorbed in a termination placed at the fourth port of the coupler. Likewise, a second, identical coupler is placed at the output of the two amplifiers, providing similar matching to the output as well as recombining the amplified signals in phase. The result is that the entire structure is perfectly matched to 50 ohms.

In addition to amplifiers, this circuit can be utilized for limiters, mixers, and various types of circuits. However, these microwave circuits may still be limited to a bandwidth of 2:1 or 3:1. In order to increase this bandwidth, multiple coupled lines sections may be utilized. In one instance, three coupled lines sections are used for a bandwidth of 4:1 or 5:1. These individual sections are more difficult to implement in planar thin-film circuitry than conventional sections. In fact, the tightness of coupling required for the center of these three sections is so tight it is almost completely impractical to implement on a thin film circuit.

Rather than the edge coupled designs used in the past or simple versions of broad side coupling not involving spirals, in the subject invention a tiny coupler useful as the center section of a multi-section directional coupler uses miniature spiral broadside coupled lines. The use of these broadside coupled spirals increases the over-coupling of the broadside coupling structure through the mutual coupling of the turns of the spiral and thus provides a tight enough coupling such that the tiny coupler can be utilized as the center section of a multi-section directional coupler. Having provided a miniaturized three section directional coupler with this technique, it can be shown that the bandwidth of such a coupler is increased to 5.1:1 or better.

The over coupling and the concomitant increased bandwidth may be achieved in a structure that can be much smaller than the elongated quarter wavelength sections described previously. This ability to achieve this structure is due to the coiling of the lines in a tiny spiral. With this structure, it can be shown that over coupling of greater than 7 dB can be achieved in a single section utilizing a back-to-back broadside coupled spiral structure and that this over coupling can be used in a multi-section directional coupler to achieve greater than 4:1 bandwidth.

The coupling of the spiral broad side structure may be so strong that it can behave in a manner that is almost an ideal transformer. Coupling factors of 0.95 are easily achieved, in which 1.0 is ideal. In addition to its usefulness by itself as a miniature coupler and in the critical middle section of a directional coupler, it is also useful as a transformer in improved filters and extremely wide bandwidth baluns.

Moreover, since there is even mode and odd mode wave propagation in the coupler, the velocities along the two spirals are different if there are differences in the dielectric utilized between the two spirals, such as the relative proximity of the ground plane below or air above the structure. Twisting the lines in the spirals can equalize these waves by making the electrical paths equal. If the electrical paths are not equal, one can have degraded performance at high frequencies.

In a preferred embodiment of a multi-section directional coupler, a center section with the tightly coupled spirals is flanked by two under-coupled outer meander line sections whose characteristics can be tuned with capacitive pads and resistors for impedance matching purposes.

As to the ability to provide such a spiral structure with requisite characteristics, providing the subject spiral structure with the appropriate impedances and other characteristics is not possible utilizing conventional planar microwave processing techniques. The reasons are that for conventional planar microwave processing, high dielectric constant insulating material is utilized between the metallized layers, and the dielectric layers are typically exceedingly thin. This precludes the ability to set electrical parameters in the tiny structures required for the miniaturized couplers, and especially for miniaturized spiral couplers.

It has been found that the use of a three layer production technology called 3MI facilitates parameter control to permit fabrication of these spirals with the appropriate dimensions and properties to tailor the impedance of the spiral structures. The 3MI process is successful primarily because in 3MI a low dielectric constant material is utilized between the layers, in one embodiment polyimide, and in which the thickness of the dielectric layer is relatively thick and on the order of 4μ. In place of the polyimide, other materials, such a bisbenzocyclobutene (BCB) electronic resin sold under the tradename CYCLOTENE may be used. The use of this 3MI process permits control of the electrical characteristics and parameters necessary to fabricate the miniaturized spiral structure, with the term 3MI referring to a layered structure with three metal layers.

As previously noted, it is extremely difficult to build a structure with sufficiently tight coupling for the center section of, for instance, a three section directional coupler to get a bandwidth wider than 4:1-5:1. As one goes to more and more sections for even wider bandwidths the structure of the center section gets even more difficult. There is also a problem with the outer sections in that the lines in the outer sections need to be weakly coupled, i.e. under-coupled. This typically requires lines that are both very large and far apart from each other, thus further increasing size. Even with meandering, the outer sections are considerably larger than the single center section meandered embodiment. By applying the MMIC Multi-layer interconnect (3MI) process it is possible, with the use of previously unavailable components, to design a multi-section coupler in the same small space, with the subject technology expanding the bandwidth to >4:1. Future expansion of the approach enables bandwidths of up to 10:1 in a space compatible with MMIC integration.

It is noted that the innermost section of a multi-section coupler must have extremely tight coupling, to levels that are not practical with existing thin film technology. A spiral broad side coupler enabled by the new processing can have coupling to very high levels, and the approaches developed allow tuning of the coupling levels. Furthermore, the outer coupling sections can also be improved with appropriate use of the 3MI capability. The solution is equally applicable to GaAs and GaN implementations. In the following, a quadrature coupler is defined to have four ports, and ideally has an equal split between the direct and coupled ports at a 90 degree phase difference, while no power exits the isolated port.

COMPARISON

The following information and table presents a comparison of available peak coupling from the range of structures under consideration showing the superiority of spiral broadside coupled lines.

Starting with a single edge coupled pair of lines, examples of available peak coupling have been determined at approximately 8 GHz and with approximately 50 ohms impedance for each of the four ports. There is over coupling if the peak of the coupling is >0 dB, and under coupling if the peak is <0 dB. Only the single edge coupled pair is under-coupled. The approximate value of the normalized impedance for the even mode is also shown in the following table:

TABLE 1

Configuration of Approximate Performance Limit (Near 8 GHz and 50 Ohms impedance)

| | Peak Coupling | Even Mode Impedance |
|---|---|---|
| Edge Coupled Single Pair | (>0 for over coupling) −5 dB (under-coupled) | (normalized) |
| 2 Pairs (Lange) | 0.0 dB | 2.4 |
| 3 Pairs (Lange) | +1.3 dB | 2.7 |
| 4 Pairs (Lange) | +1.6 dB | 2.8 |
| Spiral Pair (planar) Broad Side Coupled | 0 dB | 2.4 |
| Single Pair (3MI) | +3.9 dB | 3.4 |
| Spiral Pair (3MI back to back) | +7.5 dB | 4.9 |

As understood from Table 1, the Lange coupler implementation for planar circuitry is limited to less than 2 dB. This limitation is insufficient for use in the wider bandwidth, three section implementation. As further understood from Table 1, edge coupling increases from the single pair to the 4 pair versions over a range of −5 dB (under-coupled) to less than +2 dB of over coupling.

A pair of planar, edge coupled (non-broadside) spiral coupled lines was tested and was no more tightly coupled than 0 dB for the stated conditions. However, as to spiral broadside coupled lines, a single pair of spiral broadside coupled lines, matched to 50 ohms, can be over coupled to +3.9 dB, when fabricated using the "3MI process", which has 3 independent metal interconnect layers and will be described hereinafter. Note, a pair of back to back spiral broadside coupled lines was found to have a peak coupling of +7.5 dB in a 50 ohm matched condition. In either the case of a single pair of broadside coupled lines, or back to back pairs, the amount of strong over coupling was significant and enables use in a multi-section directional coupler to give it a wide bandwidth.

The result is a wide range of applications. It should be noted, that by adding a fourth metal layer, it is possible to further increase the over coupling by an additional 2 dB.

As can be seen, for multi-section directional couplers, with appropriate use of a specialized 3MI multilayered technology one can make extremely tightly coupled inner sections and also be able to design outer sections that are reduced in size. This 3MI technique permits stacking tightly wound spirals which serve as the center section of a three section coupler, with the tightly wound and tightly coupled spirals permitting increased bandwidth for the three section coupler in an extremely small package size. The net result is to achieve miniaturized couplers in which the tight couplings result in increased bandwidth made possible by utilizing spiral broadside coupled lines and a specialized fabrication technique to create the MMIC structures.

More particularly, it has been found that it may be theoretically impossible to obtain the desired bandwidth utilizing single section tightly coupled meander line technology. The result is that one has to go to at least a three section or a multi-section version of a directional coupler. However, in order to adjust the parameters for the coupling, one needs a specialized manufacturing technology, such as the 3MI technology, to be able to adjust the circuit parameters in the small microwave circuits. This technology utilizes a low dielectric constant material between metal layers. It is common practice to use a thin high dielectric material placed in between layers for use in structures like capacitors. This structure is inappropriate for use in coupled structures because the corresponding required line widths become extremely small, which also makes the lines very resistive and lossy. This approach severely limits design flexibility. Thus, prior techniques cannot offer the design flexibility that is achievable with the 3MI technology that uses low dielectric material between the metal layers.

Using the 3MI process, one can build structures that were not previously realizable. With the process described above, one is now able to make a miniaturized version of a multi-section coupler with very good performance. These couplers have a wider bandwidth than heretofore possible while also achieving the same accuracy of the magnitude of the split, namely the 90° phase split.

In particular with the 3MI technology one can provide a unique spiral structure with multiple metallization layers with a low dielectric constant insulator that is thick enough to give one a large degree of control over the coupling parameters and impedance parameters of the transmission lines. The 3MI process utilizes an additional set of processing steps added to standard MMIC fabrication techniques as follows:

The final metal layer from the finished MMIC process becomes the first layer of the three layer metal interconnect (3MI). A layer of dielectric material such as polyimide is deposited over the surface of the MMIC and holes are patterned in the polyimide where via connections will be needed subsequently. In one embodiment, a layer of gold is deposited and patterned on the top of this first polyimide layer. This comprises the second metal interconnect layer. The polyimide deposition and patterning, and metal deposition and patterning steps are then repeated to complete the third metal interconnect layer. This process could then be repeated additional times for additional interconnect layers. A BCB electronic resin or similar material can be used in place of the polyimide.

In one embodiment, the basic process ends up with transistors, resistors, capacitors, and a layer of interconnect metallization on the surface of gallium arsenide. The gallium arsenide also has via connections to a back side metallized ground plane. Then a layer of polyimide is put down as a 4μ thick layer of plastic. Thereafter, particular locations are provided with through-holes through the plastic that are photolithographically defined. Then, using standard semiconductor processes, through-holes are made. This allows the via connections in between the layers. Then a patterned layer of metallization is placed on top of the first layer of plastic, in one embodiment using an electroplating process used to build up a total of 2 microns of metallization. Then one provides a layer of plastic and another layer of metal interconnect is followed by making more through-holes in the polyimide and then plating up an additional metal layer on top of what has been provided, with the top layer dielectric being 4μ in thickness.

The net result is that by utilizing this process one can make very small coupled spirals for the center of a three section coupler and to adjust the properties and offsets of these spirals in such a way that one can achieve the required increased bandwidth. In one embodiment, it was also found that rather than superimposing identical spirals on top of each other, which would result in a coupling a bit too tight, the two layers could be slightly offset to be able to tune the coupling between the spirals.

By reducing the amount of overlap between metal layers, the coupling is reduced in a manner that can be tightly controlled, enabling fine tuning of the overall performance. In addition, there are interconnections between layers that provide a twisted structure that serves to equalize the signals traveling on adjacent lines. The current and corresponding fields on the lower layer couple more strongly to the substrate material, which tends to have a higher dielectric constant, and to the ground plane. Likewise, the currents and corresponding fields on the upper layer are much less affected by surrounding dielectric material. If unchecked, the differences in propagation would accumulate and degrade performance, especially at higher frequencies in the band. Instead, the currents are periodically switched between layers with an interlayer via connection. This switching, in effect, causes a half twist at each of the interlayer connections. Therefore, on average, the currents and corresponding fields and waves are subjected to similar loading. In this manner, the signal paths are equalized which tends to improve overall performance, especially at higher frequencies.

The number of twists per turn can vary. Empirically, one or two twists per turn of the spiral are sufficient. By employing low dielectric constant material between the broadside coupled metal layers in the spirals, a very wide range of coupling and impedance levels is realizable, enabling the design of miniaturized, high performance couplers with wide bandwidth when using a multi-section design. In general, it is possible for a coupler with a given number of coupled line sections to trade off ripple and bandwidth, so long as the coupling and impedance is realizable with the fabrication approach. A larger number of sections enables increasingly wide bandwidths with decreasing amounts of ripple, but nonetheless requires increasingly strong coupling in the center section. This structure is achieved using a multilayer processing scheme such as the 3MI used by BAE Systems.

According to one embodiment, a miniaturized multi-sectioned, directional coupler using a multi-layered MMIC process comprises a monolithic microwave integrated circuit, having a central section with a relatively tight coupling, surrounded by sections of lighter coupling, the relatively tight coupling being comprised of a pair of spiral coupled lines, and the lighter coupling using meandered edge coupled lines with capacitive loading of the lines in several places. Moreover, the circuit includes a plurality of metallization layers, set on the top of the monolithic microwave integrated circuit, and vertically oriented structures, situated below the corners of the meandered lines of the lighter coupling. In one embodiment, the vertically oriented structures have square pad structures to capacitively tune the coupling and impedance of the lines of the meandered edge coupler section.

The following features may be included. The coupler may have three or more metallization layers set on the top of the monolithic microwave integrated circuit, with a coupler utilizing a plurality of low dielectric constant insulation layers between the metallization layers. The low dielectric constant insulation layer in one embodiment is polyimide. In another embodiment, the low dielectric constant insulation layer may be a BCB electronic resin.

In summary, a miniaturized quadrature microwave integrated circuit is provided with an increased bandwidth due to the use of spiral broadside coupled lines and the utilization of fabrication technology that involves the utilization of a low dielectric constant material between metallization layers and an improved MMIC fabrication methodology.

FIG. 1 is a diagrammatic representation of a directional coupler composed of two parallel lines a quarter wavelength long showing a four port structure, in accordance with a first exemplary embodiment of the present disclosure. A 3 dB directional coupler 10 is generally a four port device, meaning that there are four terminals of connection or four places where voltages to ground exist as well as currents going into and out of the ports. In the simplest instance, a directional coupler consists of a pair of parallel lines 12 and 14, with line 12 connecting Port 1 to Port 3 and line 14 connecting Port 2 to Port 4. There is electromagnetic coupling between the lines analogous to that associated with a transformer except that the behavior of interest occurs primarily at a center frequency $f_0$ and to either side thereof, with the lines being a quarter wavelength long.

Figure 2:
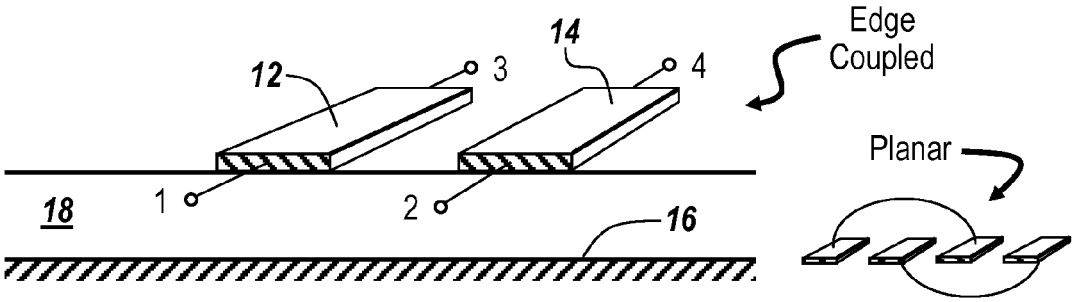
FIG. 2 is a diagrammatic illustration of an edge coupled directional coupler with adjacent lines spaced apart above a ground plane, in accordance with the first exemplary embodiment of the present disclosure.

FIG. 2 is a diagrammatic illustration of an edge coupled directional coupler with adjacent lines spaced apart above a ground plane, in accordance with the first exemplary embodiment of the present disclosure. Specifically, the planar implementation shown in FIG. 2 involves edge coupled lines, with each of the lines constituting flat conductors that are located above ground 16 or supported on a dielectric layer 18 in space. Note that there are electric fields between the two lines and electric fields to ground.

Figure 3:
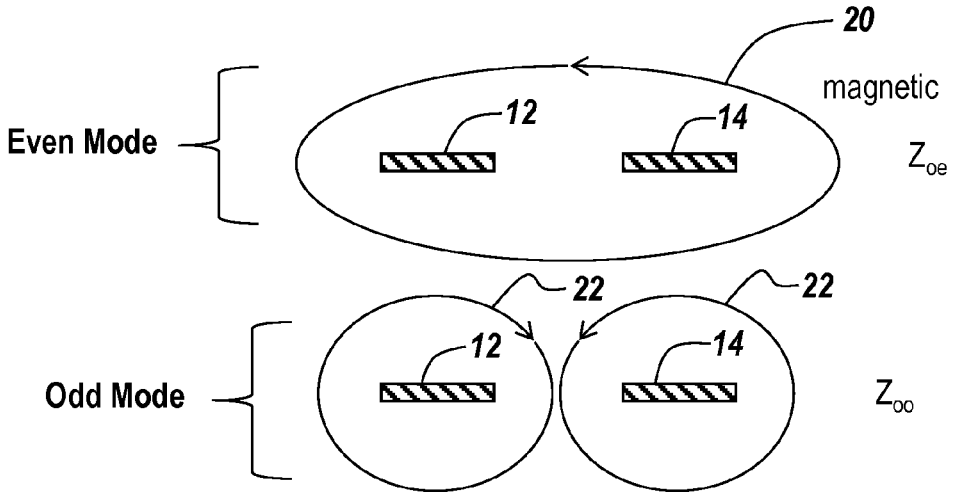
FIG. 3 is a diagrammatic illustration of even mode and odd mode magnetic coupling between the lines of the directional coupler of FIG. 2, in accordance with the first exemplary embodiment of the present disclosure.

FIG. 3 is a diagrammatic illustration of even mode and odd mode coupling between the lines of the directional coupler of FIG. 2, showing the magnetic field lines, in accordance with the first exemplary embodiment of the present disclosure. As shown, there are two modes of propagation for the coupling between these lines. The first mode of propagation is called the even mode and is illustrated by the magnetic field 20 which surrounds lines 12 and 14. The second mode is the odd mode in which oppositely rotating magnetic fields 22 respectively surround lines 12 and 14. Each of the modes of operation have an impedance with respect to ground. Because there are four ports, algebraically the modes can be broken down with different symmetries in the even mode and the odd mode. Thus, the behavior of the two modes is completely different.

In the ideal case, it is sufficient to describe the behavior of this circuit in terms of even odd mode impedances and the propagation characteristics along the transmission lines. It is noted that the even mode travels down the lines with a particular velocity assuming a gallium arsenide substrate and a polyimide dielectric, with air on top. The odd mode has its own propagation velocity. The result is that the even and odd modes propagate down the lines with different velocities. This becomes a frequency limiting factor.

However, ignoring the difference in velocities, the closer the two lines are together, the more tightly the lines are coupled. In general the even and odd mode impedances are dependent on the actual geometry in a complex fashion. The odd mode impedance tends to relate to how close the lines are to each other, and the even mode impedance tends to relate to how close the lines are to the underlying ground plane. For instance, going from gallium arsenide to polyimide, one can more readily adjust the electrical distance to the ground plane and thus the impedances. However, the lines can only be placed so close together due to the physical limit on how close together the lines can be placed.

Figure 4:
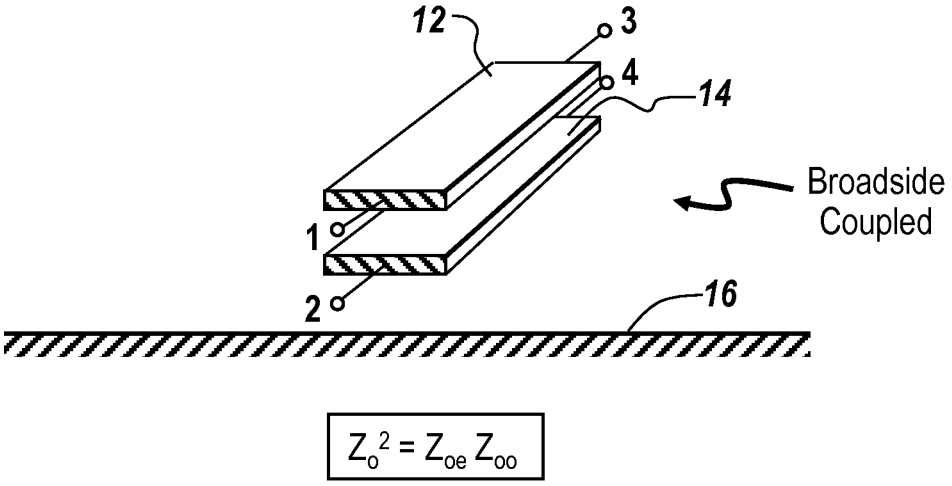
FIG. 4 is a diagrammatic illustration of the broadside coupling for the lines of a directional coupler, with the lines placed one on top of the other, in accordance with the first exemplary embodiment of the present disclosure.

FIG. 4 is a diagrammatic illustration of the broadside coupling for the lines of a directional coupler, with the lines placed one on top of the other, in accordance with the first exemplary embodiment of the present disclosure. As shown, a stronger coupling can be achieved when a broadside structure is used. Here, lines 12 and 14 are located one on top of the other above ground 16. In this case, the presence of the ground plane is a detriment. Thus, in the ideal circuit there would be no ground plane. However, ground planes are needed to build practical circuits so the ground plane must be taken into consideration. Note that the total impedance of the broadside structure is given by $Zo^2=Z_{oe}Z_{oo}$. The separation between the two lines and the dielectric constant itself may add an additional parameter for use in designing the structure.

When utilizing typical thin-film processing technology in order to obtain the appropriate impedances, extremely narrow lines should be used. These lines will have a higher resistance which becomes a practical limit to the impedances that can be achieved because of the small size. Typically, the characteristic impedance for the structure is on the order of 50 ohms. The 50 ohms is the square root of the product of $Z_{oe}$ and $Z_{oo}$. Being able to create the appropriate impedances for the coupler utilizing conventional thin-film technology is challenging because instead of a single equation of the voltage equaling some trigonometric function of distance, one has two sets of equations and thus many more parameters to deal with.

Current planar edge coupled technology offers a reasonably straightforward method to achieve a matched impedance for a single section coupler. However, this single section coupler theoretically has a bandwidth limit.

Instead of measuring voltages and currents in a microwave circuit, since one cannot usually do so, one measures power. The power in each of the lines is measured in terms of S parameters with the S parameter indicating the ratio of power in and power out of the respective ports.

Figure 5:
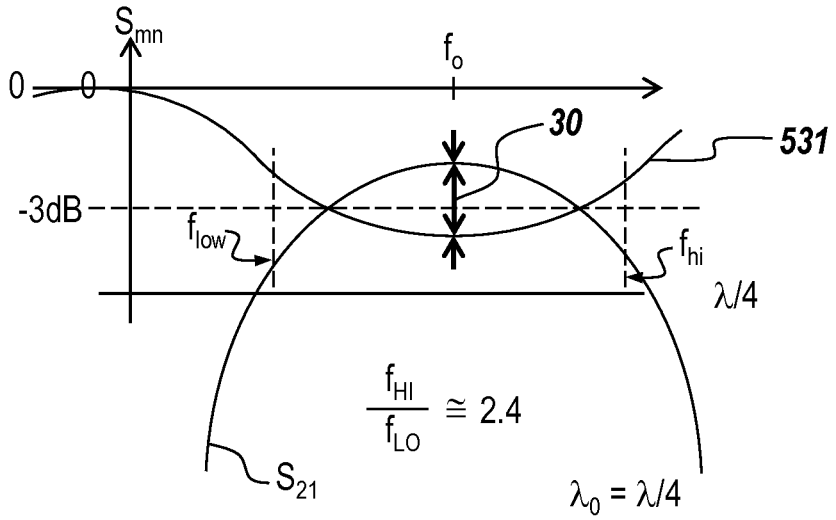
FIG. 5 is a graph of over coupling associated with a single section directional coupler which results in a bandwidth of 2.4:1 for 1 dB of overcoupling, in accordance with the first exemplary embodiment of the present disclosure.

FIG. 5 is a graph of over coupling associated with a single section directional coupler which results in a bandwidth of 2.4:1, in accordance with the first exemplary embodiment of the present disclosure. The amount of coupling between the lines, for instance S31 and S21, can be described as illustrated in FIG. 5. For an ideal 3 dB coupler with a 90° phase difference, i.e. an angle of S31/S21=90° at $f_o$, for the S31 path and the S21 path there is a peak deviation over coupling indicated by double ended arrow 30. At 1 dB over coupling between the lines one can achieve only a bandwidth of 2.4:1. The 1 dB over coupling illustrated in FIG. 5 therefore results in a theoretical maximum bandwidth of the 2.4:1 for a single coupler section.

Figure 6:
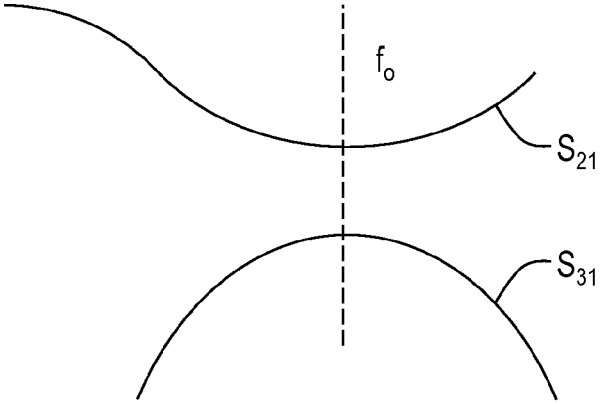
FIG. 6 is a graph of under coupling associated with a single section directional coupler, in accordance with the first exemplary embodiment of the present disclosure.

FIG. 6 is a graph of under coupling associated with a single section directional coupler, in accordance with the first exemplary embodiment of the present disclosure. An under coupling situation in which S31 and S21 do not overlap is shown. The problem therefore becomes how to achieve a greater over coupling than 1 dB to achieve the tightness of coupling required for the center section of a multi-section directional coupler.

Figure 7:
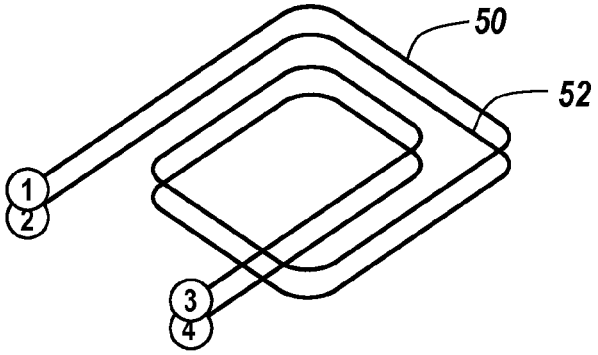
FIG. 7 is a diagrammatic illustration of a spiral broad side coupled directional coupler, in accordance with the first exemplary embodiment of the present disclosure.

FIG. 7 is a diagrammatic illustration of a spiral broadside coupled directional coupler, in accordance with the first exemplary embodiment of the present disclosure. Achieving the tightness of coupling required for a center section of a multi-section directional coupler in a compact size requires the utilization of the miniaturized broadside coupled spiral structure illustrated in FIG. 7. Here, the over-coupling is as described in Table 1 above.

With respect to FIG. 7, a first spiral line 50 is connected from Port 1 to Port 3, whereas a second spiral line 52 underneath this first spiral is positioned such that the two spirals are aligned with each other as illustrated. It is this spiral structure which constitutes a 3-dB directional coupler that can either be used singly or as part of the central portion of a multi-section directional coupler. Its utility is its exceedingly small size, as will be described, and the exceptionally tight coupling between the two lines.

Figure 8:
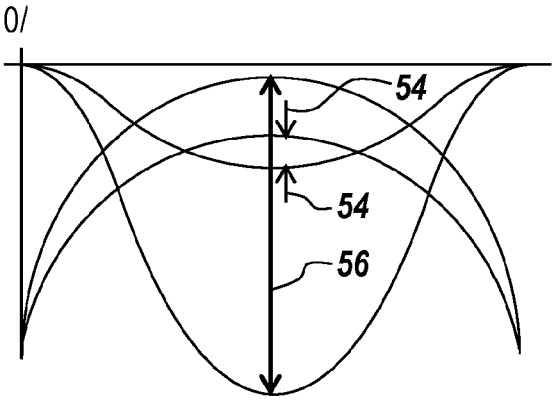
FIG. 8 is a graph showing over coupling associated with the broadside coupled directional coupler of FIG. 7, in accordance with the first exemplary embodiment of the present disclosure.

FIG. 8 is a graph showing over coupling associated with the broadside coupled directional coupler of FIG. 7, in accordance with the first exemplary embodiment of the present disclosure. As shown, the normal over coupling illustrated by double ended arrow 54 constitutes an over coupling of approximately 1 dB that is normally achievable through edge coupling. However, the over-coupling illustrated by double ended arrow 56 shows an over coupling attributable to the broadside spiral structure which provides the tight coupling necessary for a central section and a multi-section coupler.

Figure 9:
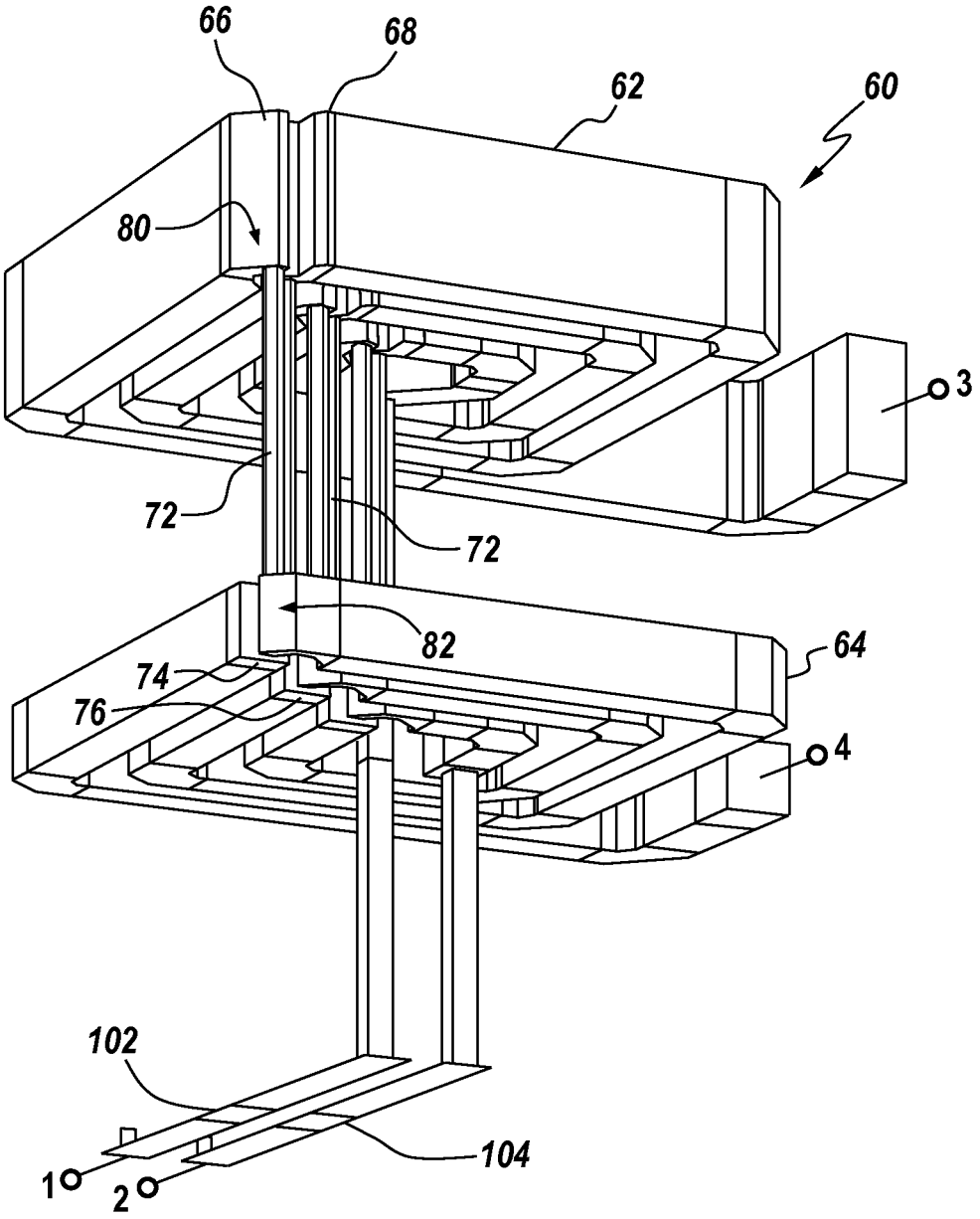
FIG. 9 is an isometric view of stacked spirals for a broadside coupled spiral structure, viewed from the bottom, in accordance with the first exemplary embodiment of the present disclosure.

FIG. 9 is an isometric view of stacked spirals for a broadside coupled spiral structure, viewed from the bottom, in accordance with the first exemplary embodiment of the present disclosure. As shown, the stacked spiral coupler 60 is composed of a top spiral 62 and a bottom spiral 64 with the bottom spiral having input ports 1 and 2 and with the output ports being 3 and 4 as illustrated. In a preferred embodiment, the stacked spiral structure has portions of the spiral that are separated, for instance at 66 and 68, and interconnected at metallized vias 70 and 72 to separations 74 and 76 in the lines of spiral 64. The path of the signal, for instance in upper spiral 62 as illustrated at 80, is transferred to the lower spiral as illustrated at 82 so that the signal travels along one path around the upper spiral and then is transferred down to the lower spiral and then back again so as to form a twisted wire structure. As mentioned before, the purpose of the twisted wire structure is to equalize path lengths in the various spirals.

Figure 10A:
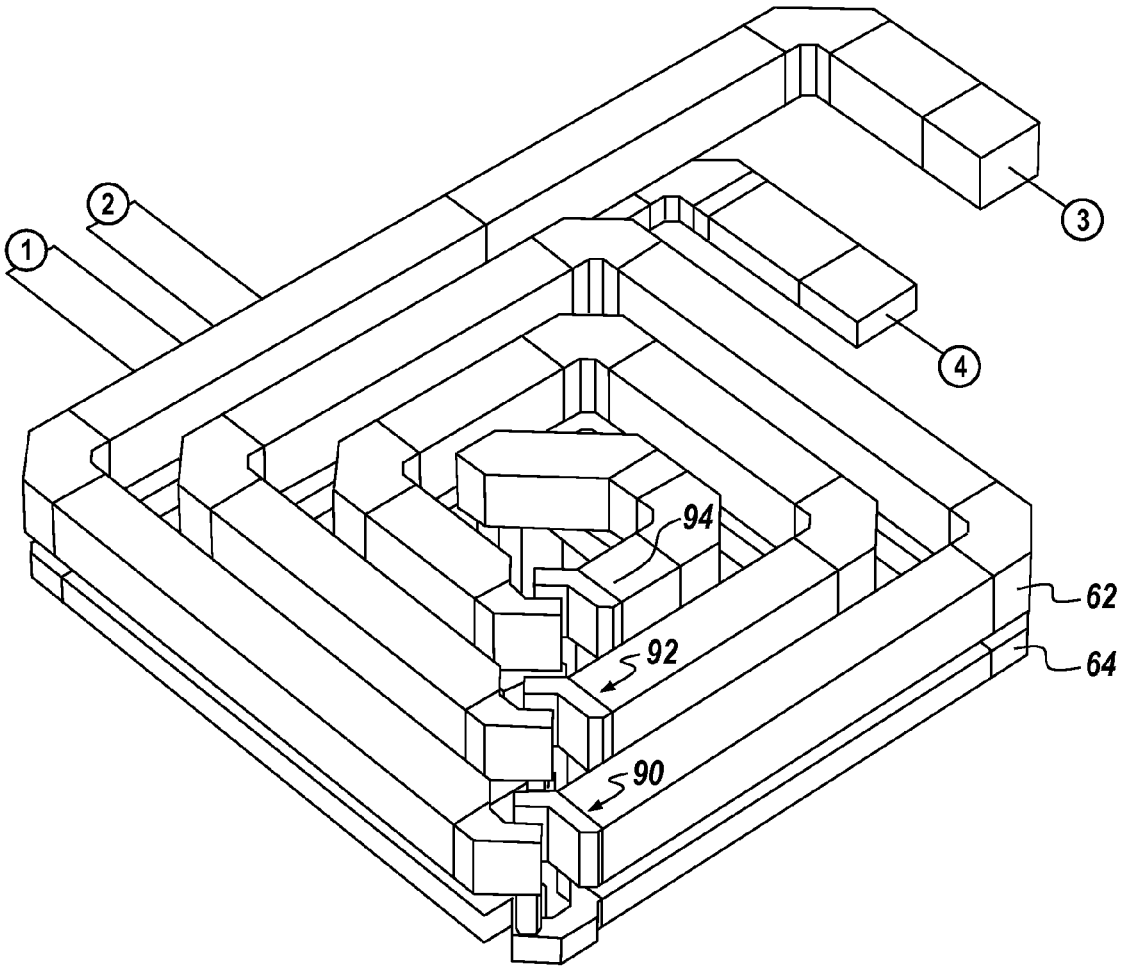
FIG. 10 A is an isometric top view of stacked spirals for the broadside coupled spiral structure of FIG. 9, in accordance with the first exemplary embodiment of the present disclosure.
Figure 10B:
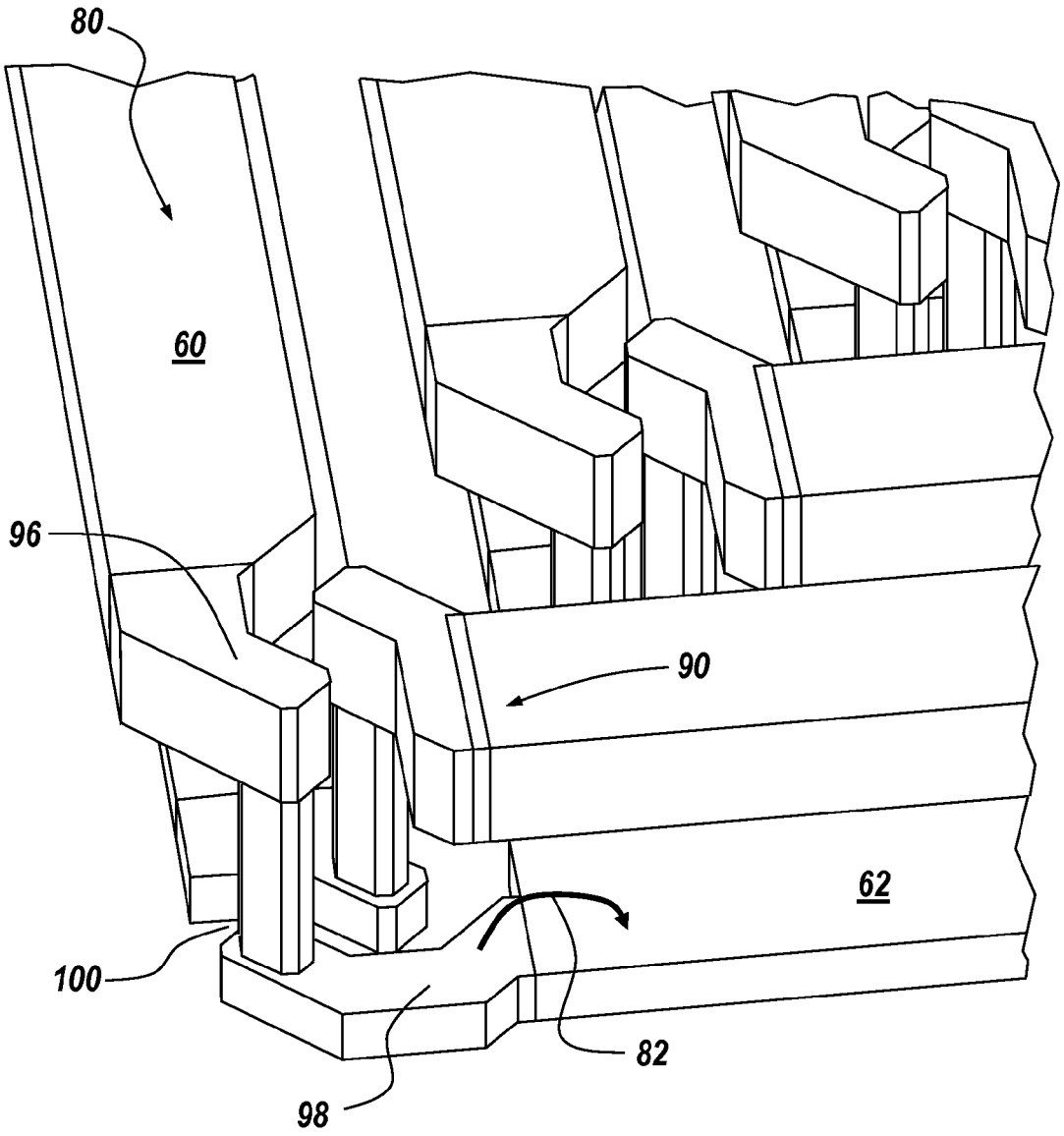

FIG. 10 A is an isometric top view of stacked spirals for the broadside coupled spiral structure of FIG. 9, in accordance with the first exemplary embodiment of the present disclosure. FIG. 10 B is a diagrammatic illustration of a twisted line configuration in which lines of the top and bottom spirals are separated and interconnected, in accordance with the first exemplary embodiment of the present disclosure. Referring to FIG. 10 A, the upper spiral 62 is shown positioned directly above lower spiral 64, with the interconnects in the separated portions of the spirals being clearly shown at the corners of the spiral at 90, 92 and 94. Referring to FIG. 10 B, the interconnect at corner 90 is shown to include a projection 96 at the separated portion of the line 60 connected at the separated portion of line 62 there beneath to a projection 98 through a metallized via 100 such that signal along the path illustrated by arrow 80 on the upper spiral is now connected as illustrated at arrow 82 to the bottom spiral.

Figure 11:
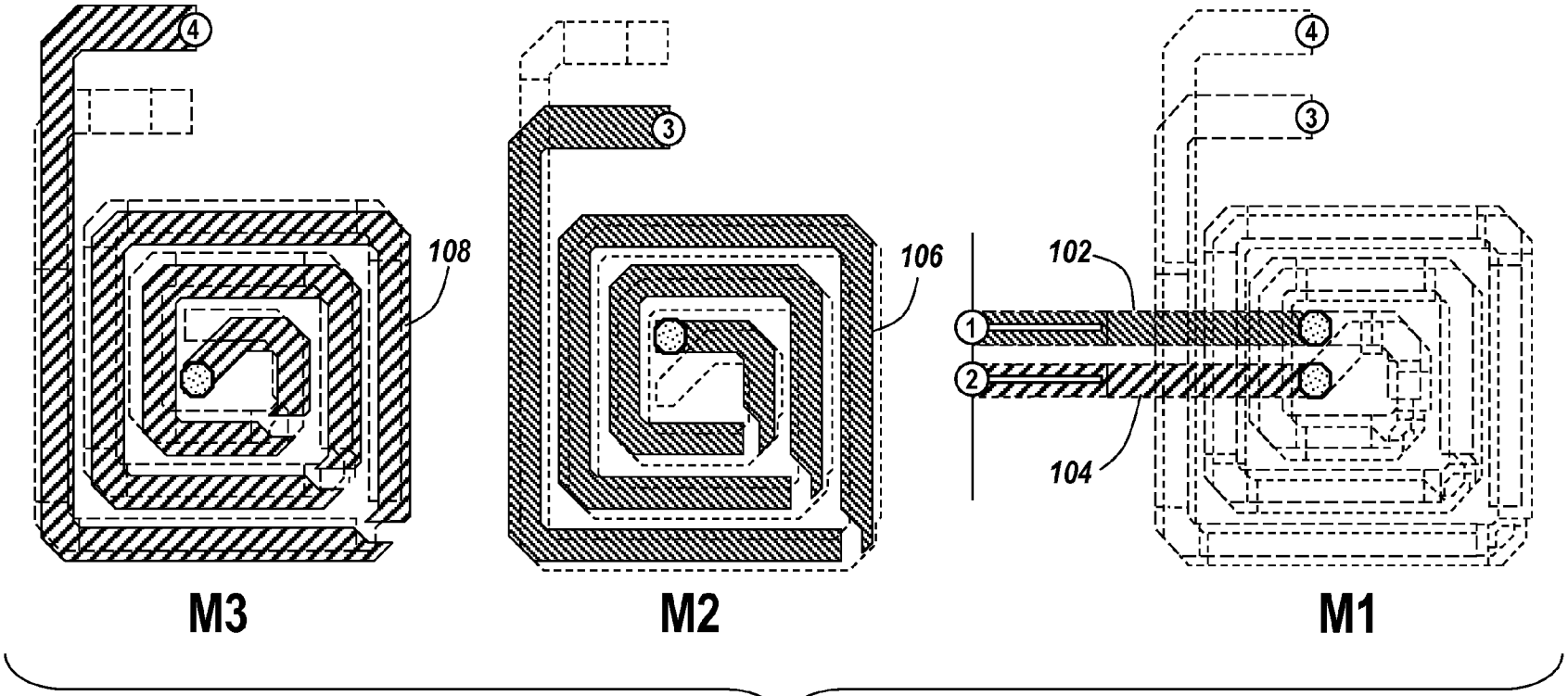
FIG. 11 is a diagrammatic illustration of the three metallization layers utilized in the formation of a directional coupler composed of stacked broadside coupled spirals, in accordance with the first exemplary embodiment of the present disclosure.

FIG. 11 is a diagrammatic illustration of the three metallization layers utilized in the formation of a directional coupler composed of stacked broadside coupled spirals, in accordance with the first exemplary embodiment of the present disclosure. The different metallized layers for the 3MI process include the lower metallized structure M1 on top of a gallium arsenide substrate that provides the input traces 102 and 104 to the lower of the two spirals. The lower spiral structure M2 is shown as the metallized portion 106, whereas the M3 upper metallized portion 108 is shown superimposed on metallized section 106.

Figure 12:
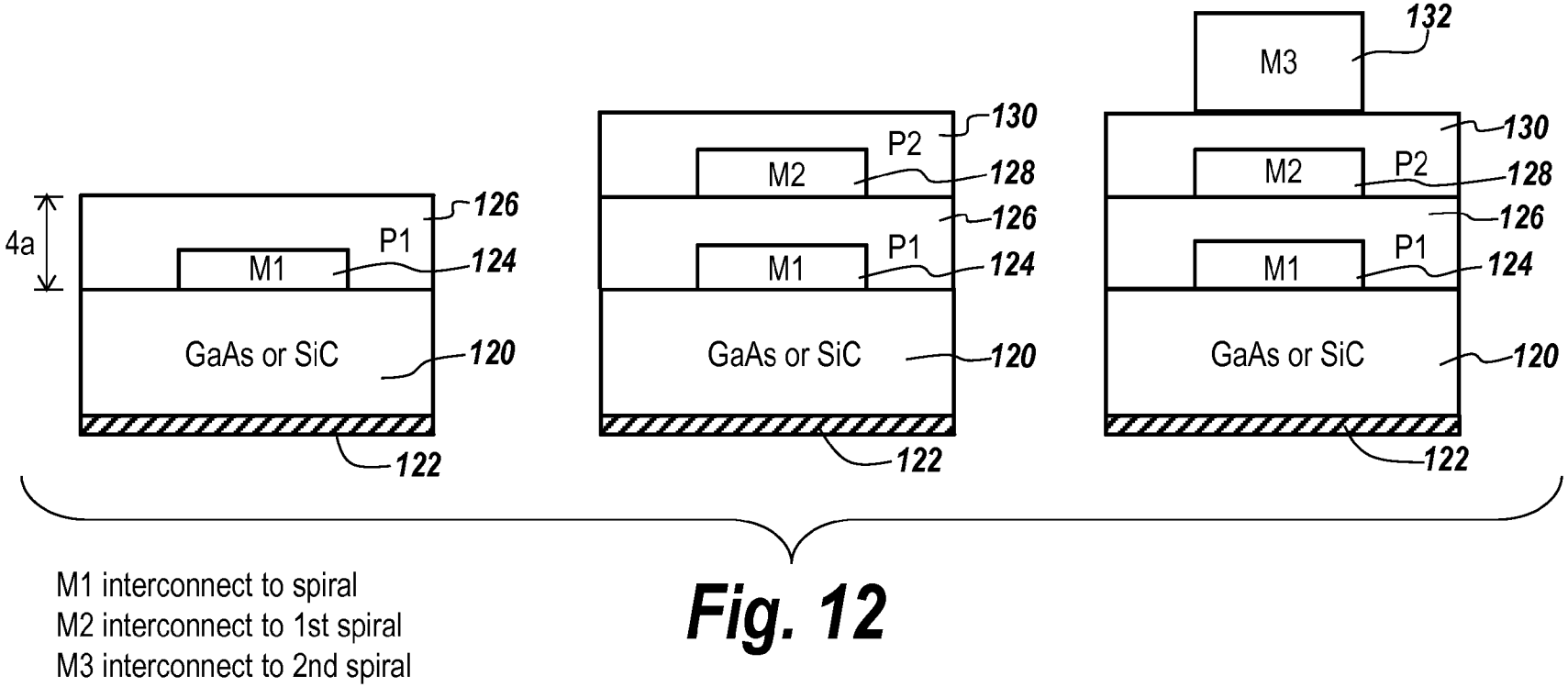
FIG. 12 is diagrammatic illustration of the processing steps in a three layer 3MI process for providing a tightly broadside coupled spiral structure illustrating the utilization of a relatively thick low dielectric material between the metallized layers, in accordance with the first exemplary embodiment of the present disclosure.

FIG. 12 is diagrammatic illustration of the processing steps in a three layer 3MI process for providing a tightly coupled broadside spiral structure illustrating the utilization of a relatively thick low dielectric material between the metallized layers, in accordance with the first exemplary embodiment of the present disclosure. The 3MI process, as shown in FIG. 12, depicts a gallium arsenide or silicon carbide substrate 120 having a ground plane 122 which is provided with a first metallization layer 124. Thereafter, a polyimide layer 126 on the order of 4μ and having a low dielectric constant is formed over the metallization M1, after which a metallization layer 128 is formed on top of layer 126 which is then over coated with a polyimide dielectric layer 130 also having a thickness of 4μ having a relatively low dielectric constant. Thereafter, the metallization layer M3, here shown at 132, is patterned on top of dielectric layer 130.

It will be appreciated that this is a three metallized layer structure, with the M1 layer corresponding to the interconnects to the first spiral and with M2 and M3 referring to the first and second spirals stacked on top of one another. As mentioned previously, it is the use of a low dielectric constant dielectric layer, such as available with polyimide, and the relative thickness of this polyimide layer that provides for the flexibility in designing of the miniaturized spirals described above.

Figure 13:
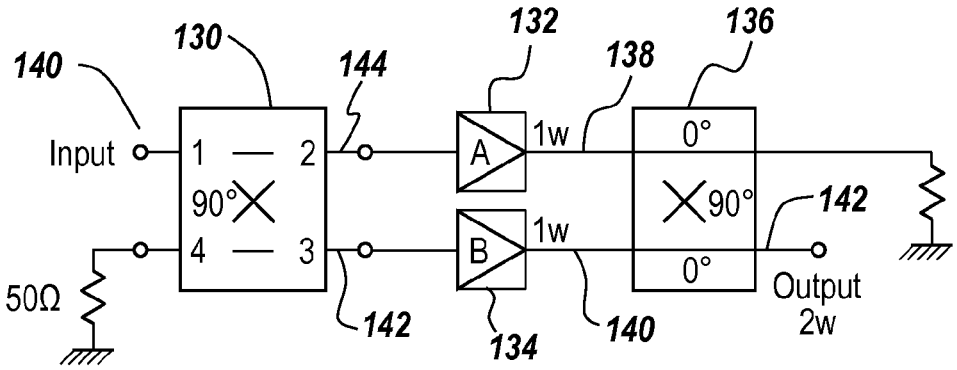
FIG. 13 is a diagrammatic illustration of the utilization of the subject directional coupler at the input and output of two amplifiers for adjusting the input and output impedances associated with these amplifiers, in accordance with the first exemplary embodiment of the present disclosure.

FIG. 13 is a diagrammatic illustration of the utilization of the subject directional coupler at the input and output of two identical amplifiers for matching the input and output impedances associated with these amplifiers, in accordance with the first exemplary embodiment of the present disclosure. As shown, a directional coupler 130 may be coupled to the input of two identical amplifiers 132 and 134 having mismatched input impedances and mismatched output impedances which are then coupled to a directional coupler 136. These two directional couplers compensate for the variation in input and output impedances of the amplifiers such that an input signal 140 at coupler 130 exits port 3 at 142 and is coupled to the input of amplifier 134, which signal is 90° phase shifted with respect to the input signal. The un-phase shifted signal at 144 is applied to the input to amplifier 132. As these amplifiers are both 1 watt amplifiers, their output signals are applied to directional coupler 136 which combines the amplifier output signals at 138 and 140, with the output signal at 138 being phase shifted and combined with the phase shifted signal at 140 to provide a 2 W output signal at 142 with all components in phase. The result of the use of these two couplers is to correct for the impedance mismatches in the inputs and outputs of the amplifiers.

Figure 14:
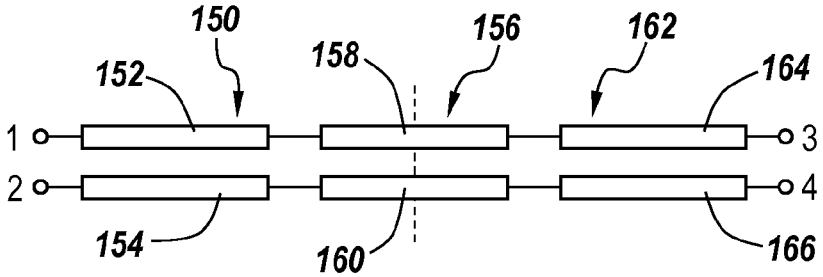
FIG. 14 is a diagrammatic illustration of a multi-section directional coupler having three sections, in accordance with the first exemplary embodiment of the present disclosure.

FIG. 14 is a diagrammatic illustration of a multi-section directional coupler having three sections, in accordance with the first exemplary embodiment of the present disclosure. In order for the couplers to be effective and broad banded, a multiple section coupler, as illustrated in FIG. 14, includes a first section as illustrated at 150 that is composed of lines 152 and 154, with the center section 156 composed of lines 158 and 160 and with the third section 162 composed of lines 164 and 166. As mentioned before, it is important that the center section 156 be exceedingly small and tightly coupled, which is provided with the aforementioned broadside coupled spiral structures.

Figure 15:
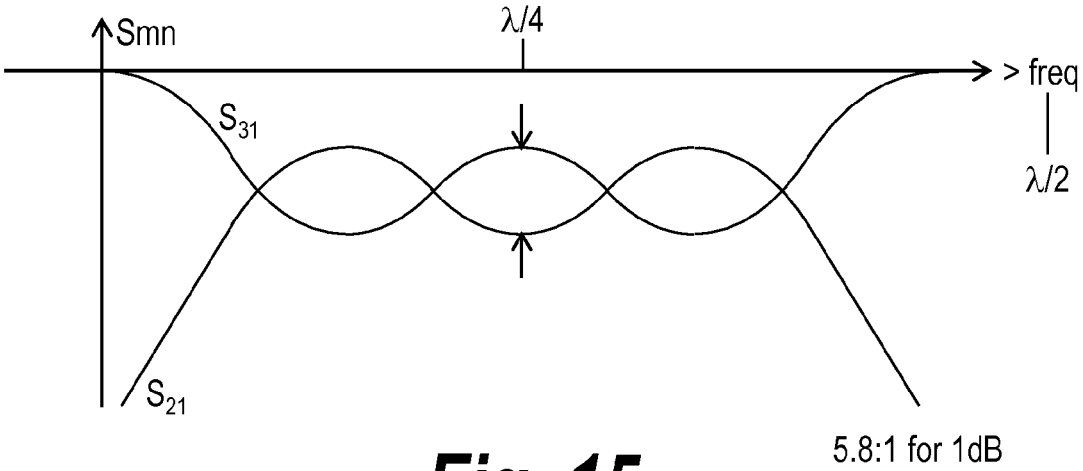
FIG. 15 is a graph showing the over coupling of the three section version of the multiple section coupler of FIG. 14, showing a maximum bandwidth of 5.8:1, in accordance with the first exemplary embodiment of the present disclosure.

FIG. 15 is a graph showing the over coupling of the three sections of the multiple section coupler of FIG. 14, showing a maximum bandwidth of 5.8:1, in accordance with the first exemplary embodiment of the present disclosure. Multiple over-coupling provided by the three sections is illustrated and provides an overall bandwidth for the structure of FIG. 14 on the order of 5.8:1 for 1 dB over couplings. Note it is the tight over coupling in the center section that results in the equivalent multiple 1 dB over couplings for the three sections.

Figure 16:
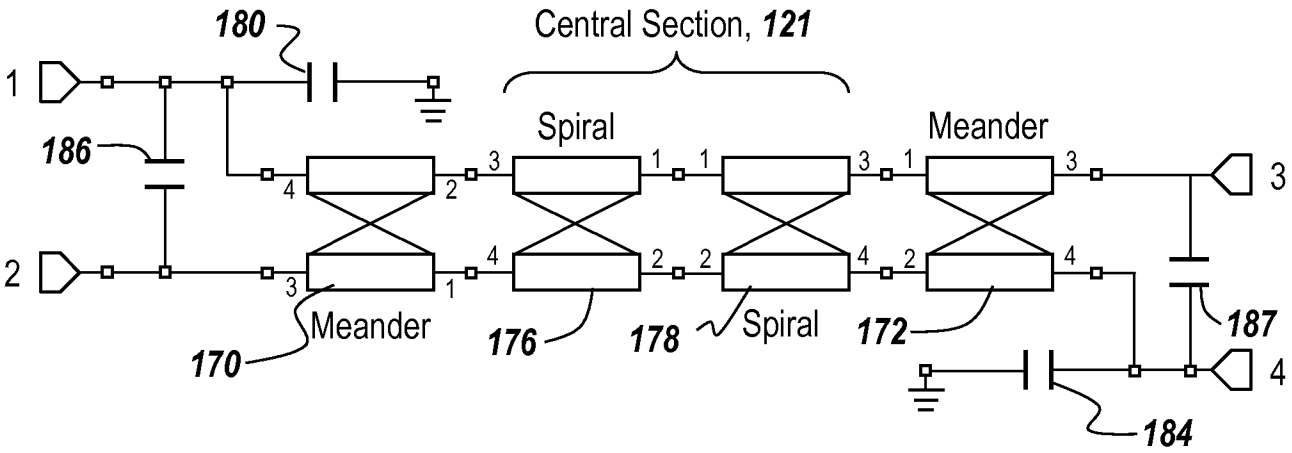
FIG. 16 is a block diagram showing a three section coupler having meander lines as outer sections and back-to-back spirals for the central section of the coupler, in accordance with the first exemplary embodiment of the present disclosure.

FIG. 16 is a block diagram showing a three section coupler having meander lines as outer sections and back-to-back spirals for the central section of the coupler, in accordance with the first exemplary embodiment of the present disclosure. As shown, a multi-section coupler is described in one embodiment as having outer meander line sections 170 and 172 and a central section 121 of the back to back spirals 176 and 178 which provide for the required tight coupling between the sections. There are capacitive elements 180, 182, 184, and 186 (not shown in current figure) which are utilized on the outer sections to adjust for the input and output impedances as required.

Figure 17:
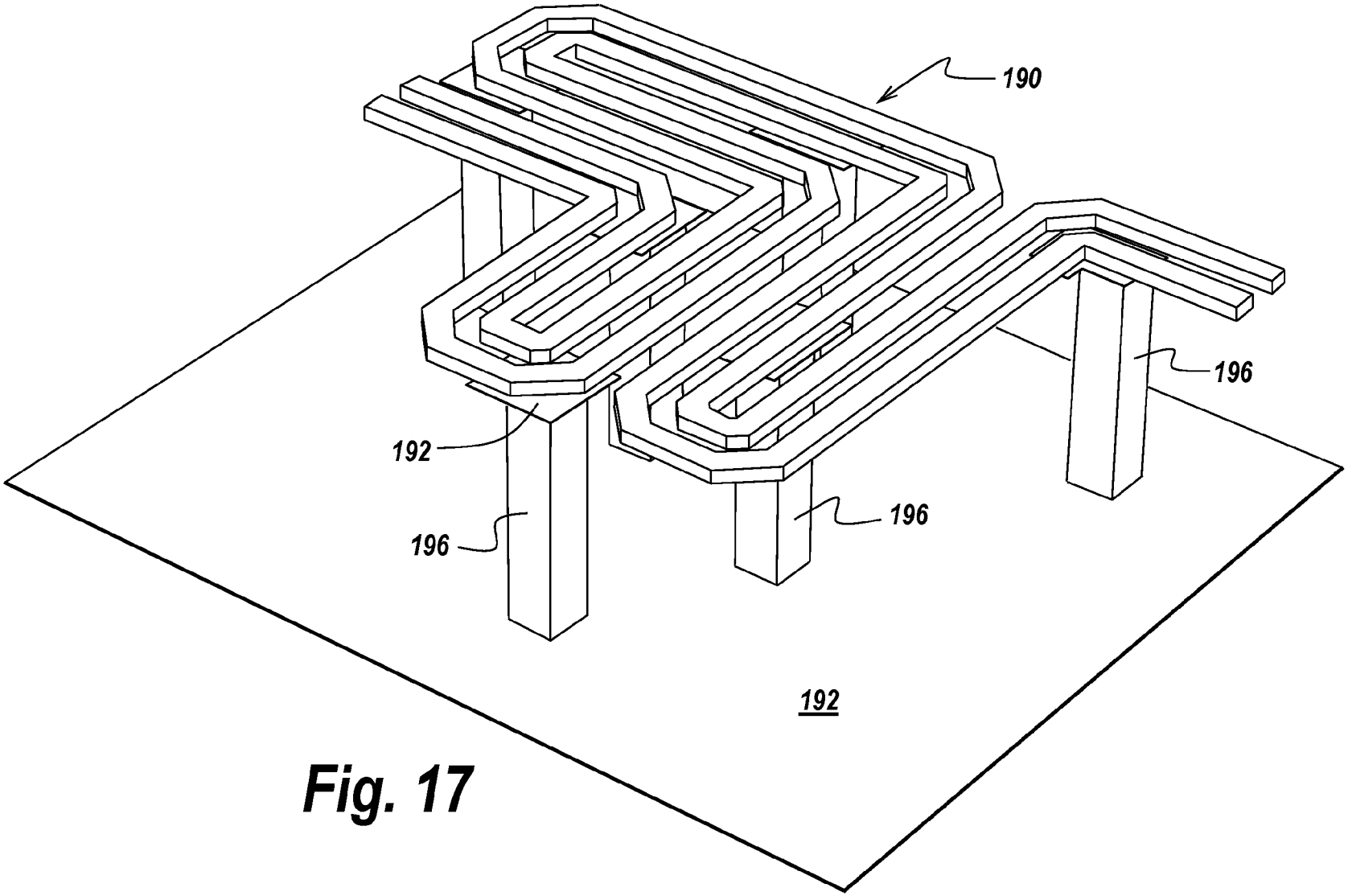
FIG. 17 is a perspective view of a meander line structure for use as meander lines in the coupler of FIG. 16, in accordance with the first exemplary embodiment of the present disclosure; and, FIG. 18 is a series of several views of the meander line structure of FIG. 17 showing the meander line and capacitive pads to adjust impedance, in accordance with the first exemplary embodiment of the present disclosure.

FIG. 17 is a perspective view of a meander line structure for use as meander lines in the coupler of FIG. 16, in accordance with the first exemplary embodiment of the present disclosure. As shown, a meander line structure for the outer sections depicts meander line 190 supported above the ground plane 192 with capacitive pads 194 coupled to the ground plane utilizing metallized vias 196.

Figure 18:
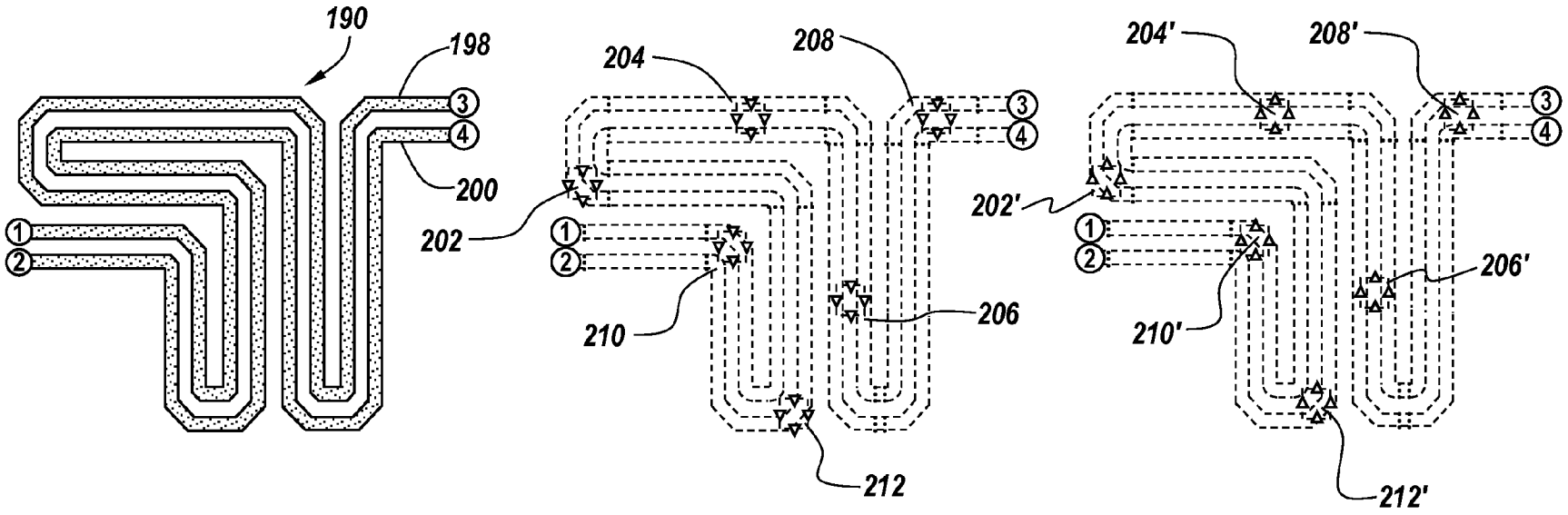

FIG. 18 is a series of several views of the meander line structure of FIG. 17 showing the meander line and capacitive pads to adjust impedance, in accordance with the first exemplary embodiment of the present disclosure. Here, meander line 190 is shown having edge coupled lines 198 and 200 and the indicated four-port structure. The capacitive adjustments to this meander line are illustrated at 202, 204, 206, 208, 210 and 212, which serve for impedance matching purposes. The via connections to the ground plane are shown respectively at 202', 204', 206', 208', 210' and 212'. It will be appreciated that this meander line structure and the tuning thereof is made possible by the aforementioned 3MI process, including the low dielectric constant dielectric layers and thickness thereof.

In short, what is provided is a multi-section directional coupler having a central section with very tight coupling, surrounded by sections of lighter coupling. The characteristics of the middle and outer sections allow design tradeoffs in bandwidth and pass band ripple. The design approach is illustrated in one embodiment by a three section coupler that operates over the 3 to 13 GHz band with approximately 1 dB of coupling variation over the band. The coupling for the inner spirals and the outer lines is approximately +4.3 dB and −14 dB respectively. This design is only slightly larger than a single section version using the conventional approach, but is much wider in bandwidth.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A miniaturized directional coupler comprising:

at least one tightly coupled broadside coupled stacked spiral, wherein said miniaturized directional coupler forms a center section of a multi-section coupler, said multi-section coupler includes coupler sections adjacent to either side of said center section, and said adjacent sections include edge coupled lines, and wherein said multi-section coupler has a bandwidth exceeding 3:1.

2. The miniaturized directional coupler of claim 1, wherein the at least one broadside coupled stacked spiral further comprises a broadside coupled stacked pair of spirals.

3. The miniaturized directional coupler of claim 2, wherein a length of each of the pair of spirals is one quarter wavelength at a center frequency at which the miniaturized directional coupler is to operate.

4. The miniaturized directional coupler of claim 1, wherein said edge coupled lines are configured as meander lines.

5. The miniaturized directional coupler of claim 1, wherein said at least one broadside coupled stacked spiral is spaced apart by an insulating separation layer having a low dielectric constant material.

6. The miniaturized directional coupler of claim 5, wherein said at least one broadside coupled stacked spiral is formed on an insulating support layer having a low dielectric constant material.

7. The miniaturized directional coupler of claim 6, wherein said low dielectric constant support layer is formed on a substrate.

8. The miniaturized directional coupler of claim 7, wherein the substrate is a material selected from the group consisting of: a gallium arsenide substrate, a silicon carbide substrate, an alumina substrate, a quartz substrate, and combinations thereof.

9. The miniaturized directional coupler of claim 5, wherein said low dielectric constant material separation layer is selected from the group consisting of a polyimide and a bisbenzocyclobutene (BCB) electronic resin, and combinations thereof.

10. The miniaturized directional coupler of claim 6, wherein said low dielectric constant support layer is selected from the group consisting of a polyimide and a bisbenzocyclobutene (BCB) electronic resin, and combinations thereof.

11. The miniaturized directional coupler of claim 1, comprising: miniaturized broadside coupled stacked spiral is used as a component in at least one of: directional couplers, baluns, microwave frequency transformers, filters, and mixers.

12. A miniaturized, multi-sectioned, directional coupler using a multi-layer monolithic microwave integrated circuit (MMIC) process, the coupler comprising:

a monolithic microwave integrated circuit, having a central section with a tight coupling surrounded by sections of lighter coupling, the tight coupling being comprised of at least one broadside coupled spiral line and the lighter coupling being comprised of edge coupled lines, wherein said miniaturized, multi-sectioned, directional coupler has a bandwidth exceeding 3:1.

13. The miniaturized, multi-sectioned, directional coupler of claim 12, wherein the at least one broadside coupled spiral line further comprises a pair of broadside coupled spiral lines.

14. The miniaturized, multi-sectioned, directional coupler of claim 12, wherein the lighter coupling further comprises meandered edge coupled lines.

15. The miniaturized, multi-sectioned, directional coupler of claim 12, further comprising capacitive loading of the edge coupled lines.

16. The miniaturized, multi-sectioned, directional coupler of claim 13, wherein said pair of broadside coupled spiral lines are formed in a plurality of separate metallization layers on the top of a semiconductor substrate, said layers being spaced apart by a first low dielectric constant insulating layer therebetween and further including a second low dielectric constant insulating layer between the lower of said spirals and said semiconductor substrate.

17. The miniaturized, multi-sectioned, directional coupler of claim 16, further comprising vertically oriented structures situated below points on said edge coupled lines, the vertically oriented structures having a pad cooperating with a point on said edge coupled line and structured to capacitively couple to the edge coupled lines.

18. The miniaturized, multi-sectioned, directional coupler of claim 16, wherein three metallization layers are set on the top of said semiconductor substrate.

19. The miniaturized, multi-sectioned, directional coupler of claim 18, further including a plurality of low dielectric constant insulation layers between the metallization layers.

20. The miniaturized, multi-sectioned, directional coupler of claim 19, wherein the low dielectric constant insulation layer is selected from the group consisting of a polyimide and a bisbenzocyclobutene (BCB) electronic resin, and combinations thereof.

21. The miniaturized, multi-sectioned, directional coupler of claim 18, further comprising at least one additional layer of metallization and low dielectric material to further refine the performance of the miniaturized, multi-sectioned, directional coupler.

22. The miniaturized, multi-sectioned, directional coupler of claim 18, further comprising multiple twists between the spiral lines of the pair of stacked spirals.

23. A method for improving the bandwidth of a multi-section directional coupler having a center section, the method comprising the step of providing the center section with a pair of broadside coupled stacked spirals, wherein the broadside coupled stacked spirals are tightly coupled and wherein the multi-section directional coupler has a bandwidth exceeding 3:1.

24. The method of claim 23, wherein each of the broadside coupled stacked spirals has a spiral line that has a length equal to one quarter the wavelength at the center frequency at which the coupler is to operate.

* * * * *